United States Patent [19]

Von Hagel

[11] 4,084,392

[45] Apr. 18, 1978

[54] APPARATUS FOR PRINTING AND FEEDING CAPS TO A BOTTLE CAPPING MACHINE

[75] Inventor: Leo J. Von Hagel, North Massapequa, N.Y.

[73] Assignee: Honeywell Farms, Inc., New York, N.Y.

[21] Appl. No.: 730,589

[22] Filed: Oct. 7, 1976

Related U.S. Application Data

[62] Division of Ser. No. 522,731, Nov. 11, 1974, abandoned.

[51] Int. Cl.[2] ..... B65B 61/00

[52] U.S. Cl. ..... 53/131; 101/44

[58] Field of Search ..... 53/131, 306, 308, 313; 101/35, 44

[56] References Cited

U.S. PATENT DOCUMENTS

| | | | |
|---|---|---|---|
| 818,893 | 4/1906 | Jung | 53/131 |
| 909,396 | 1/1909 | Gilmore et al. | 53/131 |
| 944,548 | 12/1909 | Freyer | 53/306 |
| 2,435,215 | 2/1948 | Hintz et al. | 101/44 X |
| 2,636,434 | 4/1953 | Wood et al. | 101/44 |
| 2,963,839 | 12/1960 | Floyd et al. | 53/131 |
| 3,103,165 | 9/1963 | Tripp | 101/35 |

*Primary Examiner*—Othell M. Simpson
*Assistant Examiner*—John Sipos
*Attorney, Agent, or Firm*—Abner Sheffer

[57] ABSTRACT

Apparatus for filling, capping and dating thin-walled plastic milk bottles. The date is embossed into the caps just before they are applied to the filled bottles while they are retained in indexed position by a special ratchet-pawl arrangement. The caps are screwed on by a rotating chuck having jaws that engage only a portion of the periphery of the cap. There is a lost-motion connection between the chuck and its spindle.

5 Claims, 21 Drawing Figures

APPARATUS FOR PRINTING AND FEEDING CAPS TO A BOTTLE CAPPING MACHINE

This is a divisional of application Ser. No. 522,731 filed Nov. 11, 1974, now abandoned.

Figure 1:
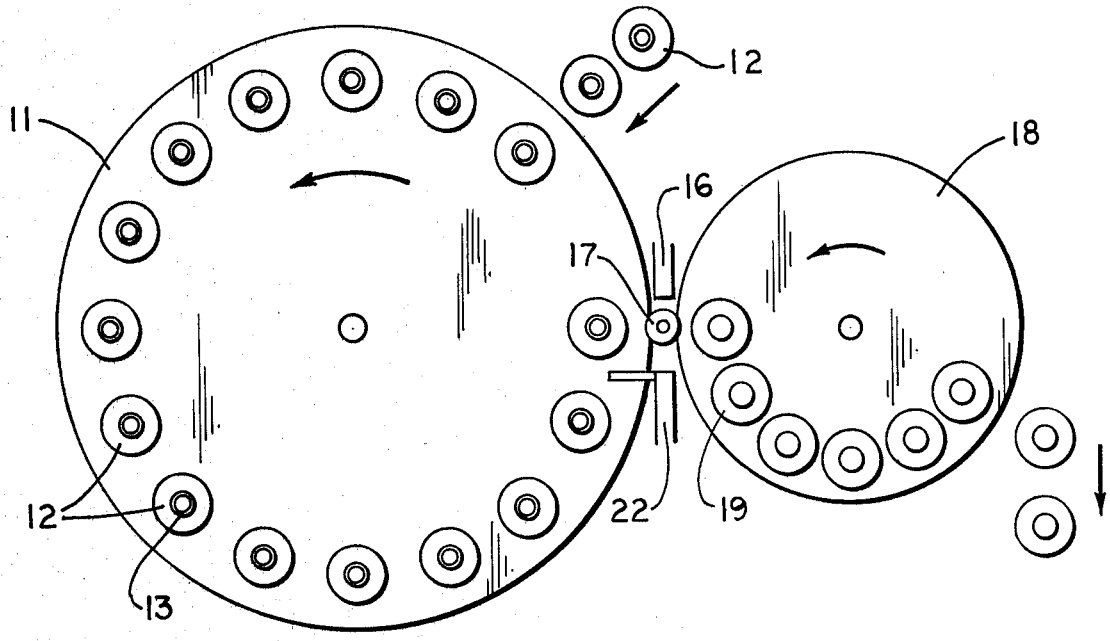
Figure 2:
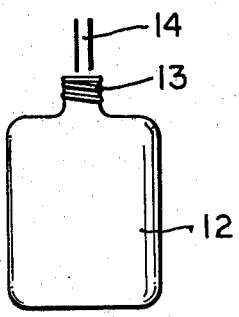
Figure 3:
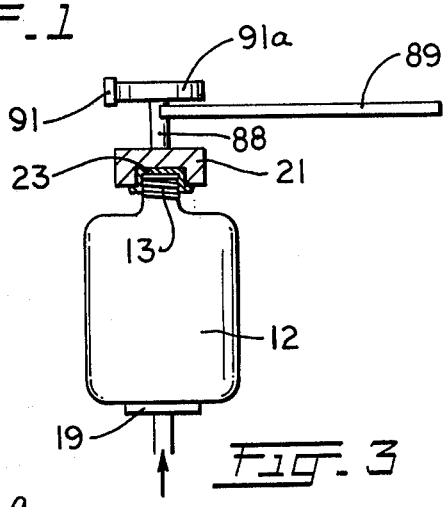
Figure 4:
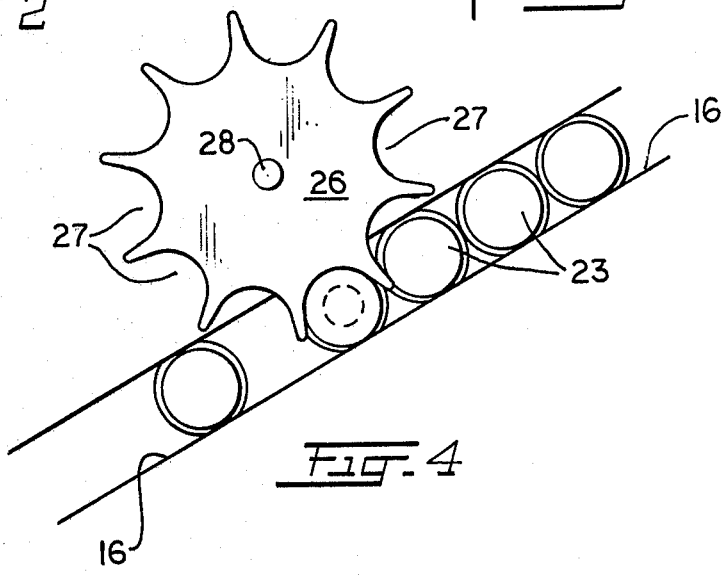
Figure 5:
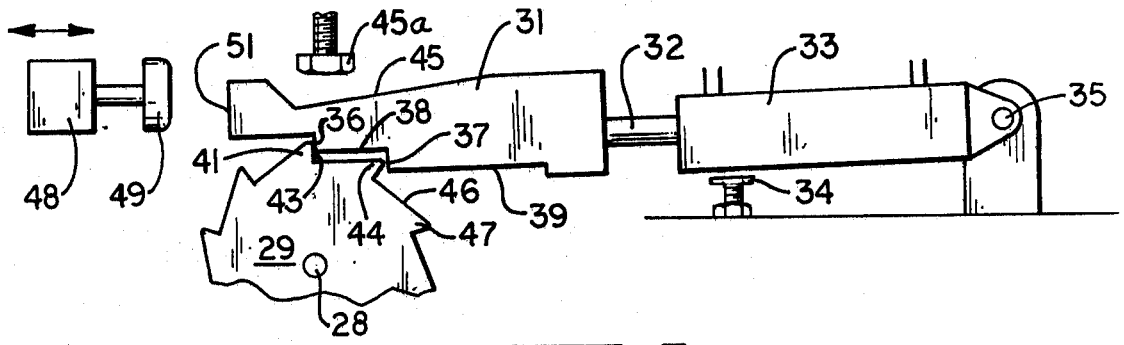
Figure 6:
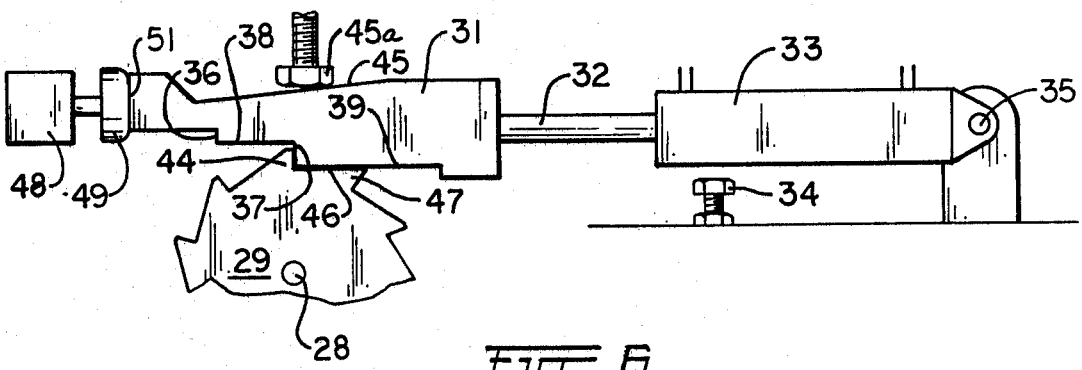
Figure 7:
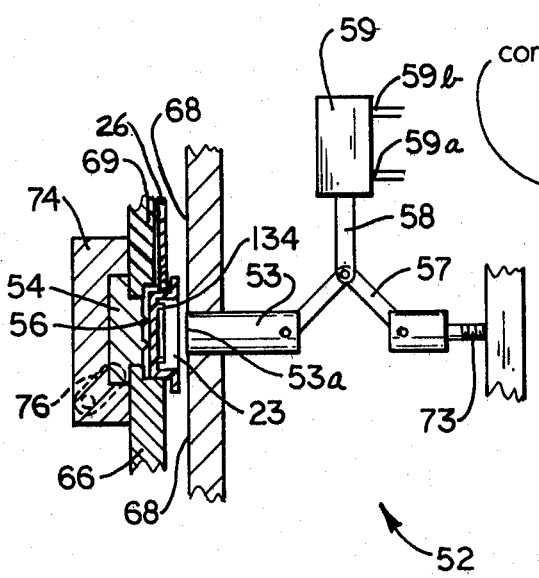
Figure 8:
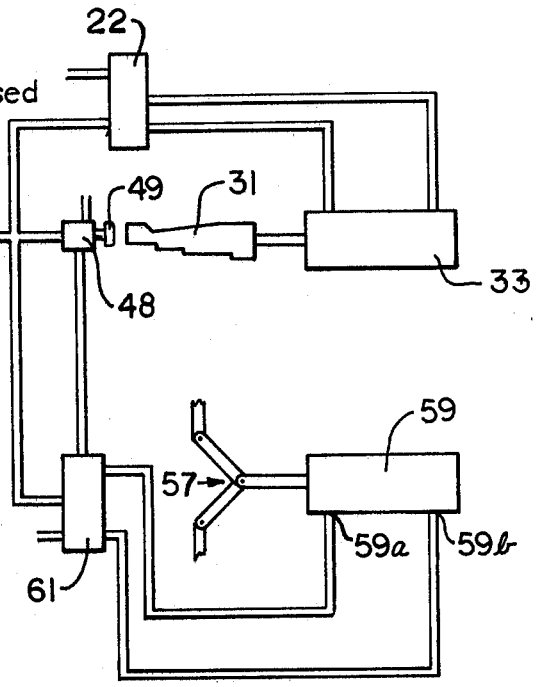
Figure 9:
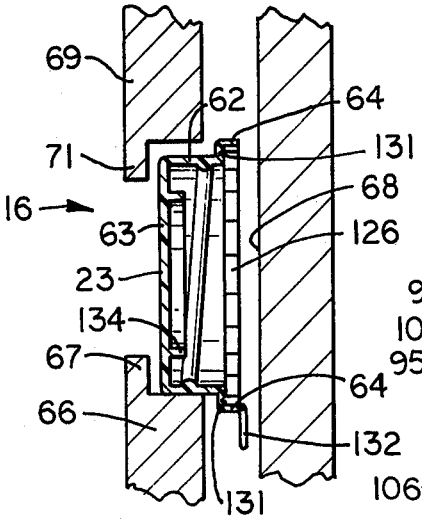
Figure 11:
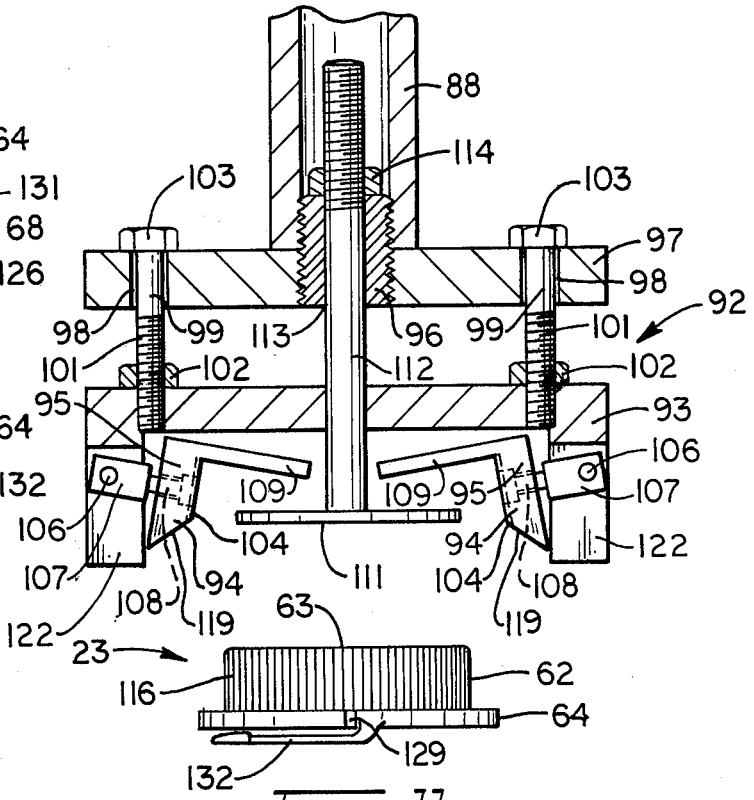
Figure 10:
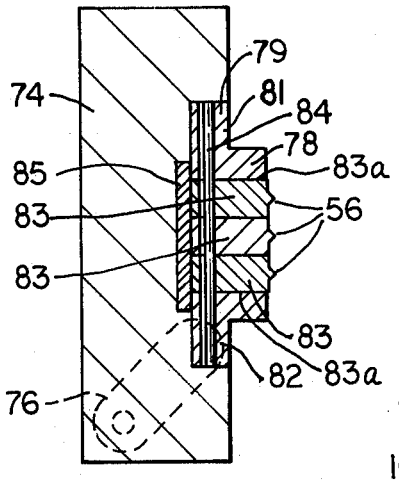
Figure 12:
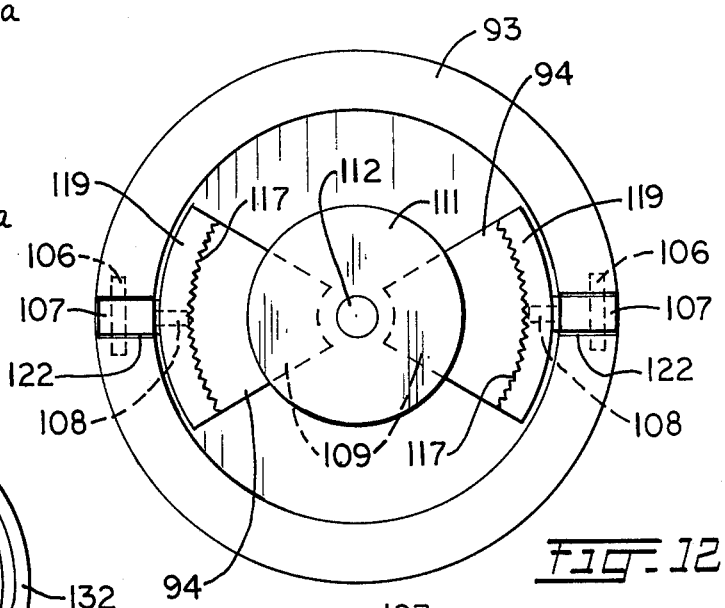
Figure 14:
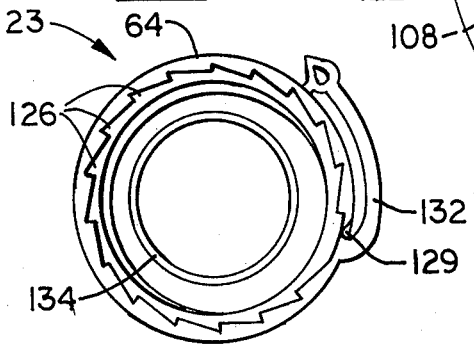
Figure 13:
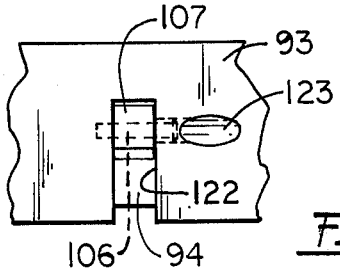
Figure 15:
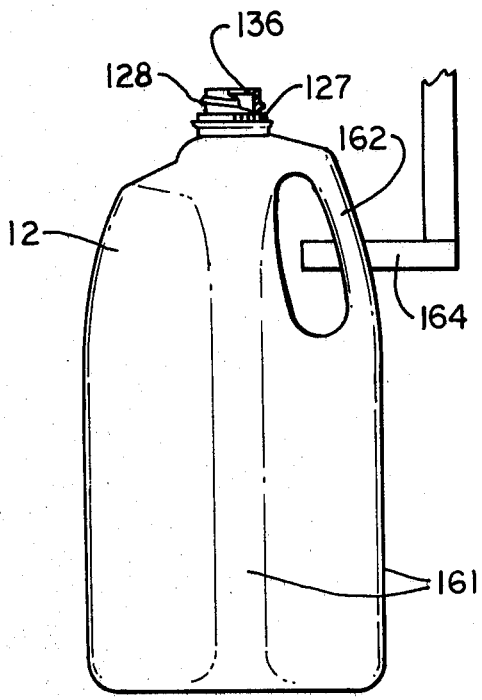
Figure 16:
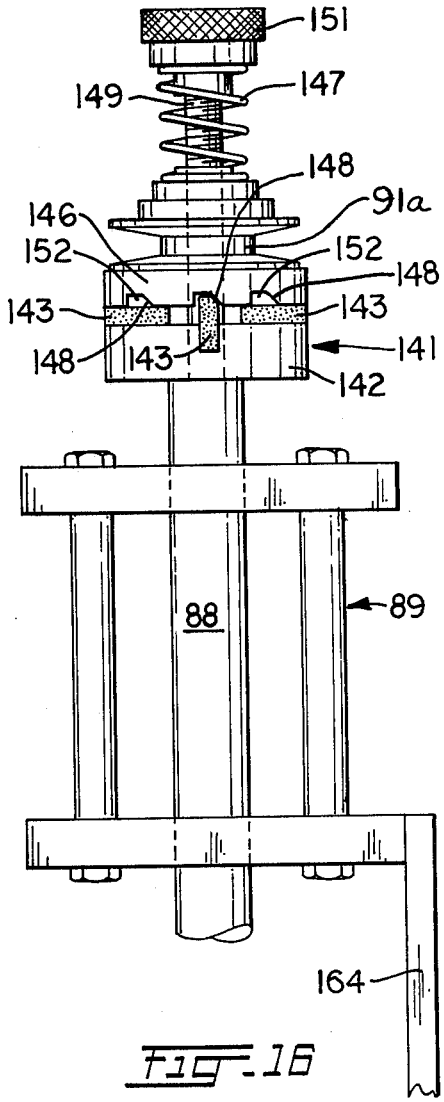
Figure 17:
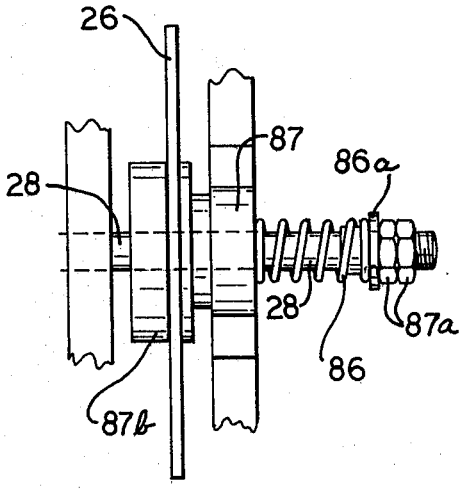
Figure 18:
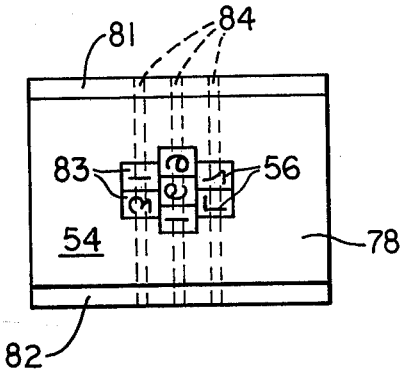
Figure 19:
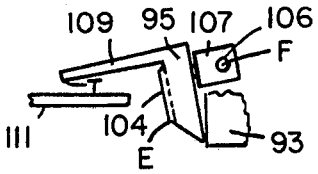

The invention relates to the filling, printing and capping of bottles. Certain embodiments of the invention are illustrated in the accompanying drawings in which FIG. 1 is a schematic plan view of an apparatus compressing a filling carousel and a capping carousel, FIG. 2 is a schematic side view showing the filling of a bottle, FIG. 3 is a schematic side view of the screwing on of a bottle cap, FIG. 4 is a schematic view of a cap supply chute and an indexing wheel holding caps in position in the chute, FIG. 5 is a side view of a ratchet-pawl arrangement for accurately positioning the indexing wheel, FIG. 6 is a view like FIG. 5 but showing the pawl in a locking position, FIG. 7 is a schematic view of a cap-imprinting or embossing unit, FIG. 8 is a schematic view (partly in section) of the pneumatic system for controlling the indexing and imprinting operations, FIG. 9 is a cross-sectional side view of the cap in the chute, FIG. 10 is a cross-sectional side view showing the construction of the imprinting die, FIG. 11 is a view, partly in cross-section of a capping chuck, showing also a cap below the chuck, FIG. 12 is a bottom view of the chuck, FIG. 13 is a side view of a detail of a pivot for a jaw of the chuck, FIG. 14 is a bottom view of a cap, FIG. 15 is a side view of a bottle, partly in cross section, FIG. 16 is a side view of a pulley and slipping impact clutch for driving the capping spindle, FIG. 17 is a side view of a friction brake for the indexing wheel, FIG. 18 is a front view of the die of FIG. 10, FIG. 19 illustrates the dimensions of a preferred chuck jaw.

Figure 20:
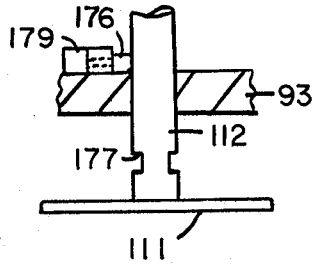
Figure 21:
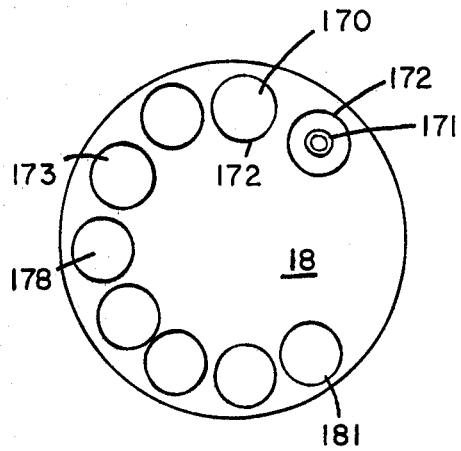

FIGS. 20 and 21 illustrate a modification, FIG. 20 being a schematic side view of a portion of a chuck and FIG. 21 being a schematic plan view of a capping carousel.

Various bottle-filling, dating and capping arrangements are disclosed in the prior art, as in Zimmerman U.S. Pat. No. 2,639,850, Lehmann et al. U.S. Pat. No. 2,313,828.

A conventional bottle-filling and capping arrangement comprises a bottle-filling carousel 11 to which bottles 12 having screw-threaded openings 13 are fed. On the carousel the bottles are moved in a circular path while the top opening of each bottle is positioned under a correspondingly moving filling tube 14 (FIG. 2) through which liquid is supplied to the bottle. After being filled, the bottles move under a cap feed line, such as chute 16 from which bottle caps fall, to a station 17 where the caps are placed over the top openings of the bottles and then, while the bottles are on a capping carousel 18, each bottle is moved upward, at location 19, so that its cap is engaged by the jaws of one of the capping heads 21 (FIG. 3). Each of these heads moves with the bottle around the carousel 18 and is also simultaneously rotated about the vertical axis of the cap to screw the cap firmly onto the bottle. The bottle then moves downward to an extent sufficient to remove the cap from the capping head.

One aspect of the invention relates to the filling and dating of blown plastic milk bottles, particularly those of light, easily deformed plastic, having molded plastic screw caps (both the caps and bottles being typically of conventional high density polyethylene). It makes it possible to run the milk filling and capping line at high speeds, with high reliability, to produce plastic-capped milk bottles bearing a substantially indelible date, and to shift to another date (for bottles intended for distribution to other localities having different dating requirements) easily during operation.

In accordance with one aspect of this invention, a device for embossing the date onto plastic caps is situated in the cap feed line and the device is actuated by the movement of each bottle on the filling carousel. In one preferred form, there is a four-way air switch 22 (FIGS. 1 and 6) in the path of the bottles leaving the filling carousel. Engagement of a bottle with the projecting sensing element of the switch 22 moves the switch to a position initiating a single cycle of a cap-feeding and embossing operation. Further movement of the same bottle out of engagement with that sensing element permits the switch 22 to return to a position in which the individual cap-feeding and embossing cycle is terminated. Then the next filled bottle engages the same sensing element, initiating a repetition of the same cycle for the next cap.

The plastic screw caps 23 (FIG. 4) are fed, on edge, by gravity along the upper part of a tilted chute or guideway 16 to an indexing wheel 26 whose circumference has a plurality of pockets 27 to receive the caps so as to move each cap, in turn, to a position to be acted on by an embossing unit.

The indexing wheel 26 is secured on a rotating shaft 28 on which is also secured a ratchet wheel 29 (FIG. 5). The assembly is driven, stepwise, by a ratchet-engaging pawl 31 at the end of a piston rod 32 of a pivotally mounted pneumatic cylinder 33 resting on an adjustable support 34 and pivoted at 35.

The pawl has two shoulders 36 and 37, behind each of which there is a step, 38, 39, respectively. When the pawl is moved in its operative direction the first shoulder 36 engages that ratchet tooth 41 which is uppermost and thus causes the wheel to turn. On continued movement of the pawl in its operative direction the first step 38 of the pawl is engaged by the tip of the next tooth 44, thereby raising the first shoulder 36 out of engagement with the first tooth 41. (The upper face 45 of the pawl is shaped to permit the pawl to rise without interference from an adjustably mounted stop **45*a*). That next tooth 44 is, however, engaged by the second shoulder 37 which causes further rotation of the wheel until the pawl reaches the end of its travel (see FIG. 6). At that stage, the second step 39 is pressed against the rear face 46 of the following tooth 47 and the pawl has become wedged between that face 46 and the stop 45*a* with which the tapered upper face 45 is now in contact; stop 45*a* prevents the pawl from tilting at this stage. In the illustrated embodiment the step 39 is slightly longer than the face 46 e.g. the distance between shoulders 36 and 37 may be about ½ inch while the face 46** is some 7/16 inch long (not including the 1/32 inch distance covered by the chamfered corner at the tip of the tooth).

The movement of the pawl also actuates an air switch 48 (e.g. a three-way push button valve whose sensing element or button 49 may be engaged by a portion of the pawl, preferably its forward end 51), to actuate the embossing unit 52 (FIGS. 7 and 8). The latter may comprise an air-operated hammer 53 adapted to be pressed against the inside of the cap 23 and an opposed dating die 54, bearing embossing indicia 56 against which the outside of the cap 23 is pressed by the action of the hammer. In the illustrated embodiment the hammer 53 is mounted for rectilinear movement at the end of a toggle 57 which is connected to the piston rod 58 of a pneumatic cylinder 59. Compressed air is supplied, from a suitable source, to that cylinder through a four-way air valve 61 (FIG. 8). The latter valve is normally biased in a direction to admit the air to the forward part 59*a* of the cylinder 59 and thus to keep the piston retracted (and the hammer in inoperative position), but this valve is shifted so as to supply the air to the rear port 59*b* of the cylinder 59 and thus to force its piston outward (to operate the hammer) by the action of the pawl-operated switch 48 which admits valve-shifting air to the four-way valve 61.

The caps 23, which are of molded plastic (such as a polyolefine), comprise an internally threaded cylindrical portion 62 (FIG. 9) having an upper wall 63 and a locking skirt 64 of larger diameter than the portion 62. The guideway 16 for the caps comprises a lower rail 66 on which the cylindrical portion of the cap rolls. The rail has a flange 67 at one side to help keep the cap on the rail and there is a wall 68 spaced from the rail at its other side which prevents the cap from falling off that side of the rail. The locking skirt of the cap fits loosely in the space between the rail 66 and the wall 68. To aid in maintaining the caps in position on the lower rail there is an upper rail 69 which is also spaced from the wall 68 and has a similar flange 71. The embossing hammer 53 (FIG. 7) is mounted in the wall 68 while the embossing die is mounted between the flanges 67, 71. The spacing between the wall 68 and the rails 66, 69 is such that the caps are loosely supported and may move laterally (e.g. 1/16 inch) on the rails, and the spacing between rails 66 and 69 is slightly larger (e.g. 1/16 inch larger than the diameter of the portion 62 of cap 63.)

The caps are engaged, in turn, by the thin disk-like indexing wheel 26 and each is thus moved to a position precisely in alignment with the embossing hammer 53 and die 54. Then the hammer moves forward to push the cap laterally against the indicia 56 of the die and to press the cap further so that the indicia penetrate and permanently deform the outer portion of the upper wall 63 of the cap. The adjustment of the toggle mounting 73 is preferably such that the hammer stroke ends positively at a point short of the die indicia (e.g. 0.01 inch from the indicia for a cap whose upper wall is about 0.05 inch thick) so as to insure that there will be a sufficient amount of plastic of the cap upper wall between the indicia and the hammer.

In the illustrated embodiment the hammer 53 is made of steel with its operative end or head 53*a* being flat and in a plane perpendicular to the hammer stroke. When the hammer is in its inoperative position its end 53*a* is preferably flush with wall 68, as shown in FIG. 7.

Owing to the toggle arrangement 57 the hammer 53 moves with its greatest force and slowest speed during the last portion of its travel, when it is engaging the plastic of the cap and pressing it against the die; its most rapid movement occurs during its travel from its initial position where it is flush with wall 68 toward the cap upper wall 63. Despite the fact that the hammer movement continues to a point where its distance from the die is considerably less than the thickness of the cap upper wall 63, inspection of the dated caps indicates that the actual depth of the date embossed thereon is only a small fraction of that wall thickness and any molded-in (usually raised) legends, such as cap manufacturer's name, on the inside of the cap are not significantly affected by the hammer blow. The date is found to be highly permanent; it resists attempts to obliterate it mechanically.

Typically the markings (date) in the resulting caps have a depth of some 0.01 inch or less and a thickness of say about 0.01 to 0.02 inch. (It will be understood that the date need not be in letters and numerals readily recognized by the general public as showing a date, but may be in any acceptable code, as is conventional). The caps are usually of a material (e.g. non-porous low-, medium or high-density polyethylene) which softens at a relatively high temperature (e.g Vicat softening point above 150° F.) and the indicia elements (and hammer) are at a much lower temperature (e.g. ambient temperature) so that the embossing occurs by cold flow.

On the next movement of the indexing wheel the dated cap is moved to a position at which it is free to roll down the guideway to the station 17 at which the caps are placed on top of the bottles. The fingers between pockets 27 of the indexing wheel or star wheel 26 give the dated cap a quick initial push to start it rolling and to overcome the tendency of the cap to stick to (or be delayed by engagement with) the die indicia elements. It should also be noted that the pockets 27 of the index wheel are (as shown in FIG. 4) preferably curved to conform closely to the curvature of the cylindrical portion 62 of caps 23; this helps keep the caps in properly indexed position.

The die 54 is removably mounted in a housing 74 (FIG. 7) fixed to the rails so that the die may be slid into and out of that housing and be locked into position by a pivoted latch 76. More particularly the die may have a portion 78 (FIG. 10) which fits, for sliding movement, just between the rails and a wider portion 79 which fits, for sliding movement, in the housing, with upper and lower shoulders 81, 82 slidably engaging the outsides of rail flanges 71, 67.

Dating indicia elements 83 carrying raised indicia 56 are supported in the hollow center cavity 83*a* of the die 54 in a manner permitting changes to be made easily. Thus indicia elements 83 may be mounted on one or more straight removable pins 84 (one pin is shown although, say, three parallel pins may be used) passing through aligned holes in the indicia elements 83 and the die, the pins being frictionally held in the die holes. It will be seen that any significant axial movement of the pins 84 is prevented, by their engagement with the housing 74, when the die is in operative position. The holes in the indicia elements 83 are large enough to permit movement of the individual indicia elements in the direction of movement of the hammer. A hardened steel back-up plate 85 mounted within the housing 74 receives the hammer force transmitted through the hard indicia elements 83, prevents deformation of the housing material and insures that the die 54 can be slid easily into and out of the housing when the date is to be changed. Thus the pins 84 are not subjected to the forces resulting from the impact of the hammer. The indicia elements are restrained against sidewise movement by the walls of the cavity 83*a*.

It will be seen that the pawl is so constructed as to move the ratchet wheel accurately over an arc of one tooth per stroke, preventing any tendency for overtravel and locking the ratchet wheel in an accurately indexed position, with the locking force being distributed over broad areas of the ratchet wheel and pawl, avoiding undue stress concentration and tendency to cold flow of the metal.

At the end of the cycle (when the switch 22 is disengaged from a bottle) the pawl 31 is retracted by the rearward movement of piston rod 32 in cylinder 33 and the ratchet wheel 29 is not restrained by the pawl. The indexing wheel 26 is preferably braked against inadvertent movement during this period. In the illustrated embodiment (see FIG. 17) the brake comprises a helical spring 86 one end of which presses against a bushing 86*a* keyed at the end of the shaft 28 for movement with said shaft; the other end of the spring presses against a bearing block 87 (for shaft 28) fixed to the frame of the device. To regulate the force on the spring the shaft 28 may be threaded at its end to receive adjustable nuts 87*a* holding the bushing 86 in place. To enable the indexing wheel 26 to be set in the precise desired relationship to the movement of its driving elements it may be adjustably supported on a hub 87*b* keyed to the shaft 28.

At the beginning of its return stroke, the retraction of pawl 31 permits the air switch 48 to return to its original position causing the valve 61 to shift, so that the embossing hammer 53 is retracted by compressed air admitted to the forward part 59*a* of cylinder 59.

The use of the indexing arrangement illustrated herein has made it possible to operate at high speeds, such as 150 bottles (and caps) per minute, for long periods without repairs or adjustments and without misprinting of caps (resulting, for instance, in damage to the sealing rings of caps) and consequent waste of bottles and milk.

The air switch 48 is preferably adjustably mounted and its position is pre-adjusted so that it does not become actuated until the pawl has just reached the end of its travel. Also, the pawl-operating pneumatic cylinder 33 preferably gives a faster stroke than the hammer-operating cylinder 59 (e.g. cylinder 33 is of smaller diameter than cylinder 59 and, in the illustrated arrangement, thereby moves its piston more quickly). Accordingly, the pawl stroke is always concluded by the time the hammer acts on the bottle cap. If the feed wheel jams (e.g. because the presence of an undesired scrap of plastic in the chute) the pawl does not reach the end of its travel and the printing hammer is not actuated.

The capping carousel 18 has a plurality of driven rotating hollow spindles 88 (FIG. 3) each of which is supported (by suitable means, such as a star wheel 89 that rotates with the carousel) directly over the cap on a bottle carried by the carousel. The spindles may be driven by a belt 91 through pulleys 91*a* operatively connected with the spindles.

In accordance with one aspect of this invention each capping head comprises a chuck 92, (FIGS. 11 and 12) supported by one of the spindles 88, and having a housing 93 carrying pair of opposed jaws 94 (whose main bodies are indicated at 95) which engage the periphery of the cylindrical portion 62 of the cap along opposed arcs while leaving substantial portions of that periphery between those arcs out of engagement with the jaws.

Preferably the chuck housing 93 is supported for limited axial movement with respect to the spindle 88. In the illustrated embodiment, the spindle is secured, by internal threads thereof, to the externally threaded nipple 96 of a supporting plate 97. That plate has spaced holes 98 to loosely receive the shanks 99 of bolts 101 secured to the housing 93 (and locked thereto by nuts 102) so that the housing is supported by the engagement of the lower faces of the bolt heads 103 with the top of the plate 97 and the housing 93 can move up and down with respect to the plate.

Each of the two jaws 94 has an arcuate cap-gripping surface 104, both arcs being on substantially the same circle centered on a vertical axis. Each jaw is double pivoted. It is pivoted for limited rocking movement to bring the lower portions of the gripping surfaces closer to that vertical axis; to this end each jaw is mounted on a horizontal pivot pin 106 which is supported in the housing 93 and which passes through a lug 107 projecting outward from the main body of jaw 94. It is preferably also pivoted, for limited rocking movement, about a generally horizontal axis at right angles to the pivot pin 106; to that end the lug 107 is pivotally connected by a pin 108 to the body 95 of the jaw 94. Each jaw has an integral inwardly extending arm 109. These arms 109 are adapted to be moved to pivot the jaws about the pins 106, by the small upward force resulting from the previously mentioned upward movement of the bottle at location 19 of the capping carousel.

Preferably there is a flat circular freely rotatable plate 111 mounted between the arms 109 and the bottle cap. This plate 111 is fixed at the end of an axial rod 112 which can move freely up and down and can also rotate freely in its bearing 113 in the nipple 96. The plate 111 is biased to its lower position (where it is out of contact with the arms 109) by its own weight; an adjustable stop 114 on the rod 112 limits this downward movement. Both the upper and lower surfaces of the plate 111 are smooth; thus the plate can remain stationary (in its upper position in contact with the arms 109), while the chuck (including those arms) rotates, and can also rotate relative to the generally smooth plastic cap upper surface 63 against which it is pressed. It will be understood that at the moment that the bottle cap is moved upward into engagement with the plate and jaws the entire chuck is already rotating rapidly.

The outer surfaces of the cylindrical portions 62 of the caps preferably have closely spaced grooves 116 extending parallel to the axis; the cap-engaging surfaces 104 of the jaws 94 have similarly spaced grooves 117 (FIG. 12) extending parallel to the axis. Preferably the cap-engaging surface of each jaw extends over an arc of less than about 90°, such as about 70°. It is found that the resulting partial engagement (e.g. only 140° of the 360° periphery) actually gives better gripping, without caps or bottles sticking in the chuck and causing jams. Below the cap-gripping surfaces 104 the jaws have downwardly flaring tapered portions 119 (e.g. having smooth surfaces flaring outwardly at a 45° angle) to direct the cap smoothly into position.

The chuck assembly is mounted so that it floats on the container and allows the cap to follow the natural pitch of the screw thread without being forced down on the bottle or over the threads. The bolts 101 are preferably so adjusted that the chuck housing 93 can travel freely upward in response to the action of the lifter 19 (see FIG. 3) on the bottle and cap so that when the lifter 19 is substantially at the top of its stroke the upward travel of the chuck housing 93 has not yet been restrained by the vertically fixed plate 97. Thus the force exerted on the bottle by the capper is about equal to the weight of the chuck housing 93, plate 111 and associated vertically movable elements.

It will be seen that the capper operates under gravitational forces, at low pressures, without the need for any springs, snap rings or similar elements to assist in engaging or disengaging the caps.

In one embodiment the total vertical downward travel of the cap as a result of its rotation on the threaded mouth of the bottle is about ⅛ inch, the adjustment of bolts 101 is such that the free travel of the chuck housing 93 is greater than that (e.g. about 3/16 inch) and the weight of the floating chuck assembly is considerably less than the force that would deform the bottle, e.g. a chuck assembly weight of about one pound with a thin walled disposable high density polyethylene blown bottle of half gallon capacity which itself weighs only about 2 ounces. Such a bottle, whose wall thickness is less than 0.5 mm at some points, can be deformed, e.g. at its neck, when a relatively small force is applied to it axially: for instance the neck having portions of alternately larger and smaller radius may be deformed like a bellows.

In a preferred embodiment there is provision for adjusting the jaws to fit various caps of different manufacture, which caps may differ somewhat in diameter or in height. To this end each pivot pin 106 is removably mounted in the housing 93, and each pin 108 is fixed to (e.g. integral with) the lug 107 and screw-threaded into the main jaw body 95, with a fine thread. Thus by removing the pivot pin 106 one can remove the whole jaw from the housing 93, rotate the lug 107 with respect to the main jaw body 95 so as to screw these parts closer or further apart, as desired, and then replace the so-adjusted jaw in the housing, reinserting the pivot pin 106. In adjusting the jaws one may proceed by hand by trial-and-error, with the particular batch of caps to be used, to insure that the jaws hold firmly onto such cap when in closed position, it being understood that the jaw surfaces 117 may engage all, or only part of, the height of the cylindrical portion 62 of the cap.

To hold the jaw parts in their adjusted position the lug 107 is preferably non-circular (e.g. approximately square as shown in FIG. 13) and it is housed in a correspondingly shaped cavity (e.g. slot 122) in the housing 93. Thus in the illustrated embodiment the adjustment may be made in steps of a quarter turn of the lug 107, with the lug fitting in the cavity 122 at each quarter turn. The end of pivot pin 106 may be screw-threaded into the housing 93 and the latter may be cut away at 123 to permit the pin to be screwed out of its operative position.

The construction and arrangement of the jaws 94 is such that they grip the cap extremely firmly, without slippage, even when very little force is applied (through plate 111) to arms 109 and even when the parts are wet (e.g. with milk).

FIG. 19 shows one preferred arrangement, to scale. In this arrangement the construction is such that the cap-gripping surfaces 104 are at a slight angle to the vertical when the device is not engaged by a cap and the plate 111 is in its lower position (not acting on arms 109); that is, the inside lower portion of housing 93 acts as a stop (engaged by the lowest, outermost, portions of jaw bodies 95) to maintain the jaws with their cap-gripping surfaces nearly vertical. The previously described adjustment of the jaws can be effected so that the jaws will be very close to, or actually just grazing, the cap portion 62 when the jaws are open and the cap is lightly (and partially) inserted upwards between the jaws. It will be observed that by providing an outward extension of the jaw (i.e. lug 107), and by locating the pivot pin 106 in that outward extension, the jaw is given a relatively long effective operating lever arm (extending from its fulcrum F at the axis of pin 106 to the tip T of arm 109) which is considerably longer (e.g. more than 50% longer) than the reacting lever arm (which extends from that fulcrum F to the lower edge E of the cap-engaging portion 104 of the jaw). By locating the pivot pin 106 at a lower level of the jaw, that reacting lever arm is made shorter than it would be if the pivot pin were at the upper level of the jaw. Also locating the pivot pin at that lower level rather than at the upper level changes the path of movement of the lower edge E so that (when the jaw tilts to engage the cap) the inward component of that movement is considerably smaller than its upward component. (In the embodiment illustrated in FIG. 19 the lower part (e.g. the lower half) of cap engaging portion 104 thus moves toward the cap surface 62 while its upper part moves away from that cap surface). This construction provides a large mechanical advantage and thus a large gripping force in response to a small upward force on the plate 111. Thus in the embodiment illustrated in FIG. 19 the ratio of arm TF to arm EF is in the neighborhood of 2:1, the angle TFE is well below 90° and the mechanical advantage is in the neighborhood of 6:1. It will be understood that instead of a pair of moveable jaws, only one jaw may be movable while the other may be fixed. Also the spaces between the jaws need not be completely open; thus, in those spaces there may be stationary guide jaws, which may be located so that they help to guide the caps into position but do not engage the caps after the caps are gripped between the two opposed gripping jaws. Less desirably the chuck may have movable jaws engaging more than half the perimeter of the cap; e.g. four movable jaws each engaging the cap along an arc of almost 90° so that substantially the entire perimeter of the cap is engaged by movable jaws.

In one embodiment of the invention the cap and bottle are constructed, in known manner, so that the screwed-down cap is locked in place by a ratchet arrangement. To this end the cap 23 is molded with internally directed integral teeth 126 (on its locking skirt 64, FIGS. 9 and 14) adapted to ratchet against corresponding externally directed integral teeth 127 molded at the lower part of the mouth 128 of the bottle 12 (FIG. 15). The skirt 64 has a break or line of weakness 129 and there is a connected circumferential line of weakness 131 joining the skirt to the rest of the cap; this enables the consumer to unlock the cap by stripping the skirt off the cap, as by pulling on a projecting flap or handle 132 integral with the skirt. The cap also has a thin annular integral depending sealing flange or ring 134 which is adapted to be pressed against a corresponding resilient integral sealing lip 136 at the top of the mouth 128 of the bottle.

As previously stated the spindles 88 may be driven by belt 91 through a pulley 91*a*. In a preferred form the pulley is connected to the spindle by a slipping impact clutch 141 (FIG. 16) so that when the cap is screwed down completely or almost completely the spindle (and chuck) are given a series of repeated impacts under limited controlled torque. In the illustrated embodiment the clutch is made up of a lower plate 142 which is fixed to the top of the spindle 88 and has upwardly projecting teeth 143 and an upper plate 146 which is fixed to rotate with the pulley and which is forced down toward the lower plate by means of a spring 147 so that shoulders 148 on the upper plate engage the teeth of the lower plate. There is a cam interaction between the teeth 143 and the shoulders 148 (e.g. the shoulders are sloped and the shoulder-engaging edges of the teeth are bevelled, as shown) so that, when the force being transmitted from the pulley to the spindle becomes too great, the clutch slips because the rotating upper plate rises against the force of the spring and this is effectively disengaged from the lower plate for a short period of time; that is, until the upper plate has rotated into a position in which its shoulders 148 are again in registry with the teeth 143 and thus exert an impact on the teeth. In the illustrated embodiment, the pulley and upper plate are fixed together and mounted for free rotation on an extension 149 of the spindle 88; the extension is threaded to carry a correspondingly threaded nut or stop 151 against which the upper end of the spring 147 is pressed, so that the spring force may be adjusted by rotating the stop 151 on the extension 149 to the desired extent, thus setting the torque at which the clutch will slip. The mating teeth and shoulders may be radial, as shown, and the teeth (and/or shoulders) may be of tough yieldable impact-resistant material such as molded nylon. The shoulders may be formed, for instance, by cutting radial notches 152 in a steel upper plate.

As illustrated in FIG. 15, the bottle 12 may be of generally rectangular shape, having bevelled corners 161 and an integral hollow handle 162. During the capping operation the bottle may be prevented from rotating with the chuck by any suitable means such as a stop 164 in the path of the handle 162 of the bottle.

The arrangement of the cap-applying station 17 may be of conventional type, such as an arrangement (not shown) in which the cap from chute 16 hangs vertically with part of it in the path of the bottle, so that the top of the mouth of the moving bottle engages the lower part of the hanging cap, thereby tipping the cap off its supports and placing it on the mouth, after which the bottle and cap pass under a plate positioned to gently press the cap onto the mouth. If desired the cap, on the bottle, may then move past another plate positioned to be engaged by the grooved portion 62 of each cap so as to rotate the cap slightly to screw it onto the mouth.

As indicated previously, plastic bottles and caps are not entirely uniform and even within given batches the torque needed for properly screwing on the cap will vary. The use of repeated impacts enables one to set the torque (for slippage) at about the lowest feasible value and nevertheless operate successfully for those caps and bottles that are more difficult to screw together. In the illustrated form the upper plate 146 has eight shoulders 148 (arranged uniformly on its face) cooperating with four uniformly arranged teeth 143, thus providing some eight impacts per turn of the driving pulley. In general, it has been found that best results are obtained when there are more than four impacts per turn (e.g. 6 or 8 impacts per turn).

It will be seen that in the illustrated arrangement the torque (for slippage) is substantially independent of the downward pressure exerted by the chuck assembly on the cap and bottle, since (as previously described) there is a lost motion connection between the chuck and the spindle. The torque (for slippage) is thus determined by the setting of the spring 147 and the size and shape of the mating teeth 143 and shoulders 148. It has been found that desired full closure, sealing and locking of the cap can be accomplished, while overcoming any tendency for caps to be stripped off during the screwing-on operation, by making the torque (for slippage) quite low and relying more on numerous repeated impacts to effect full closure. To this end the cam angle between the shoulders 148 and the teeth 143 is preferably relatively low. Thus the slope of shoulders 148 may be well below 45°, preferably about 35° to 40° (e.g. 37°) so that with a given spring setting the force needed to cause slippage is low while the forceful impact resulting from the spring action is retained. Consistently good capping is obtained even when the parts (including the chuck jaws and the shoulders 148 and teeth 143) are wet with milk.

In one preferred embodiment the cap makes a full turn on the mouth of the bottle. During the first three quarter turn the ratchet teeth 126, 127 are out of engagement. The ratchet teeth are preferably closely spaced, successive teeth being circumferentially spaced by less than 15° (e.g. by about 10°).

It is also within the broader scope of the invention to insert a cap in the chuck before that cap is placed on a bottle, hold the cap in the chuck by retaining the plate 111 in its raised position, by suitable means, and then align a filled, uncapped bottle with the chuck, move the bottle relatively upward into engagement with the cap, and screw the bottle onto the cap, the plate-retaining means being rendered inoperative at some time after the bottle has first been pressed against the cap. Thus, as shown in FIGS. 20 and 21, the caps may be fed to a suitable device for pushing them up into the chucks 21 (which, as previously noted, may be supported by the moving star wheel or spider 89). For instance, the caps may be placed (e.g. at location 170) on the pedestals of the capping carousel 18, each of those pedestals being modified so as to support a cap centrally of the pedestal (as by providing a circular groove 171, on each pedestal 172, to receive the skirt 64 and tab 132 of the cap) and by lengthening the travel of the pedestal so that (when the pedestal is in the cap-feeding portion of the carousel, e.g. at location 173) it rises high enough to place the cap in the chuck. To hold the plate 111 in its raised position there may be a spring-pressed detent 176 which may engage a circumferential groove 177 in rod 112 of plate 111. The pedestal is then lowered; it receives a filled uncapped bottle at location 178; and it is then raised to push the mouth of the bottle into aligned contact with the cap held in the rotating chuck and thus to begin screwing the cap onto the mouth of the bottle. A solenoid 179 (mounted with the detent 176 on chuck 92) may operate to retract the detent for a short period of time when the rotation of the star wheel 89 and carousel has brought the parts to the location 181 at which the bottle is to be lowered to bring the screwed-on cap out of the chuck. Then, on removal of the cap, the plate 111 and its rod 112 fall to a position in which the detent 176 is out of alignment with the groove 177; the solenoid may then be de-energized. Suitable electrical connections (such as spring contacts and appropriate wiring) may be provided for energizing the solenoid when the chuck arrives at the predetermined location.

For use in filling milk bottles (in which operation the apparatus often becomes wet with milk) all the parts will be made of stainless steel, where possible, as is common in the industry. Instead of pneumatic operation, electric operation may of course by employed.

It is understood that the foregoing detailed description is given merely by way of illustration and that variations may be made therein without departing from the spirit of the invention. The "Abstract" given above is merely for the convenience of technical searchers and is not to be given any weight with respect to the scope of the invention.

I claim:

1. In an apparatus for filling, capping and dating bottles, comprising means for feeding bottles through said apparatus, bottle filling means, means for feeding plastic caps to the filled bottles and means for applying said caps to said bottles, the improvement comprising means for printing a date on said caps before they are applied to the bottles, said printing means including cap-imprinting means and indexing means for accurately locating the caps successively in printing position in fixed relationship to said imprinting means, said indexing means including pawl means, means for driving said pawl means, cap engaging means, a toothed ratchet wheel operatively connected to said cap engaging means and driven by said pawl means, the construction and arrangement being such that during the driving of said pawl means said pawl means engages a tooth of said ratchet wheel to move said ratchet wheel and means to wedge said pawl means against the teeth of said ratchet wheel to prevent movement of said ratchet wheel.

2. In an apparatus for filling, capping and dating bottles, comprising means for feeding bottles through said apparatus, bottle filling means, means for feeding plastic caps to the filled bottles, and means for applying said caps to said bottles, the improvement comprising means for printing a date on said caps before they are applied to the bottles, said printing means including cap-imprinting means and indexing means for accurately locating the caps successively in printing position in fixed relationship to said imprinting means, said indexing means including pawl means, means for driving said pawl means, cap engaging means, a toothed ratchet wheel operatively connected to said cap engaging means driven by said pawl means, said pawl means having a first shoulder for engaging a first tooth of said ratchet wheel to move said ratchet wheel, a second shoulder for engaging the next tooth of said ratchet wheel to move said ratchet wheel further, and a blocking face for substantially conforming to the rear face of a tooth of said ratchet wheel, and means for keeping said faces in contact to prevent further movement of said ratchet wheel.

3. Apparatus as in claim 2 in which said pawl means comprises a reciprocating pawl having said first and second shoulders and said blocking face, said pawl driving means comprises a pivotally mounted reciprocating drive means for reciprocating said pawl, said apparatus including a stop adapted to be engaged by said pawl, the construction and arrangement being such that on movement of said pawl in its operative direction its first shoulder engages said first tooth, on continued movement the pawl is engaged and tilted by the tip of said next tooth thus moving said first shoulder out of engagement with said first tooth while said second shoulder engages said next tooth thereby further rotating said ratchet wheel until said blocking pawl face and the rear face of the tooth following said next tooth are brought into said contact and said stop is engaged by said pawl and prevents tilting of said pawl.

4. Apparatus as in claim 3 including means, responsive to each bottle fed to said cap-applying means, for actuating said reciprocating drive means, and means responsive to the movement of said pawl to said blocking position for actuating said imprinting means.

5. Apparatus as in claim 4 in which said reciprocating drive means comprises a pneumatic cylinder and said imprinting means comprises a hammer for engaging the inside of a cap located in printing position, a dating die having raised indicia against which the outside of said cap is pressed by said hammer and a pneumatic cylinder for driving said hammer.

* * * * *